US006254522B1

(12) United States Patent
Schmidt, V

(10) Patent No.: US 6,254,522 B1
(45) Date of Patent: Jul. 3, 2001

(54) SEPARATOR FINGER APPARATUS

(75) Inventor: Charles Louis Schmidt, V, Florence, WI (US)

(73) Assignee: C. G. Bretting Manufacturing Co., Inc., Ashland, WI (US)

( * ) Notice: Subject to any disclaimer, the term of this patent is extended or adjusted under 35 U.S.C. 154(b) by 0 days.

(21) Appl. No.: 09/412,256

(22) Filed: Oct. 5, 1999

(51) Int. Cl.[7] ..... B32B 1/26

(52) U.S. Cl. ..... 493/412; 493/416; 493/357; 493/414

(58) Field of Search ..... 493/412, 416, 493/357, 450, 410, 415, 414, 419, 411, 421, 451, 453, 413, 433, 437; 270/39, 39.02, 39.05, 5, 30; 74/96, 102

(56) References Cited

U.S. PATENT DOCUMENTS

| | | |
|---|---|---|
| 1,991,411 | 2/1935 | Novick . |
| 1,992,179 | 2/1935 | Blosser et al. . |
| 2,011,236 | 8/1935 | Winter et al. . |
| 2,631,845 | 3/1953 | Zuckerman . |
| 2,787,468 | 4/1957 | Novick . |
| 2,929,624 | 3/1960 | Brooker . |
| 2,954,881 | 10/1960 | Hopton et al. . |
| 3,044,228 | 7/1962 | Peterson . |
| 3,163,413 | 12/1964 | Franke et al. . |
| 3,207,361 | 9/1965 | Marcalus . |

(List continued on next page.)

FOREIGN PATENT DOCUMENTS

| | | |
|---|---|---|
| 219396 | 1/1962 | (AT) . |
| 372031 | 3/1923 | (DE) . |
| 442935 | 4/1927 | (DE) . |
| 719833 | 4/1942 | (DE) . |
| 321873 | 11/1929 | (GB) . |
| 1479299 | 7/1977 | (GB) . |
| 646301 | 2/1966 | (IT) . |
| 116974 | 8/1946 | (SE) . |

OTHER PUBLICATIONS

Terminology As Applied To Bretting Chain Driven Separator Transfer–Tilt.

*Primary Examiner*—Stephen F. Gerrity
*Assistant Examiner*—Sam Tawfik
(74) *Attorney, Agent, or Firm*—Michael Best & Friedrich LLP

(57) ABSTRACT

A separator finger apparatus and method for insertion of a separation finger into and removal from a stream of web product. The unique motion provided by the elements making up the separation finger apparatus permits the separation finger to be mounted close to folding rolls (from which the web product issues) with reduced separation finger-to-folding roll interference. Specifically, the separation finger is manipulated to rotate and translate simultaneously as it is inserted into or removed from the stream of web product. The elements creating the separation finger motion are preferably a pivot arm mounted for rotation about a first axis and a translation member mounted for rotation about a second axis. The pivot arm is preferably rotatably coupled to the separation finger at a third axis. The separation finger is preferably coupled to the translation member for translational or sliding motion therealong. With these connections, a rotational movement of either the pivot arm or the translation member about their respective first and second axes causes the simultaneous rotation of the translation member (and attached separation finger) and orbiting of the separation finger about the first axis. This motion creates an arcuately-shaped path for the separation finger, which thus translates and rotates into the stream of web product with less folding roll interference than a circular path would produce and with gentler motion to the web product than a purely linear translation would produce. The invention permits longer web separation fingers to be used, which in turn requires fewer separation fingers.

23 Claims, 4 Drawing Sheets

U.S. PATENT DOCUMENTS

| | | | | |
|---|---|---|---|---|
| 3,254,889 | | 6/1966 | Nystrand . | |
| 3,279,792 | | 10/1966 | Kostal et al. . | |
| 3,298,683 | | 1/1967 | Stroud . | |
| 3,331,183 | | 7/1967 | Gass . | |
| 3,351,215 | | 11/1967 | Kitch . | |
| 3,538,778 | * | 11/1970 | Harris | 74/96 |
| 3,552,828 | * | 1/1971 | Lawrence et al. | 74/96 |
| 3,557,688 | | 1/1971 | Hartbauer et al. . | |
| 3,624,723 | | 11/1971 | Cannon . | |
| 3,656,271 | | 4/1972 | O'Shea et al. . | |
| 3,739,886 | | 6/1973 | Kertzman . | |
| 3,766,701 | | 10/1973 | Besserdich et al. . | |
| 3,784,187 | | 1/1974 | Takayanagi et al. . | |
| 3,784,188 | | 1/1974 | De Ligt . | |
| 3,834,689 | | 9/1974 | Lee et al. . | |
| 3,866,905 | | 2/1975 | Trogan et al. . | |
| 3,948,504 | | 4/1976 | Woessner et al. . | |
| 3,977,152 | | 8/1976 | Rochla et al. . | |
| 4,070,014 | | 1/1978 | Takahashi . | |
| 4,190,242 | | 2/1980 | Bolza-Schunemann . | |
| 4,279,410 | | 7/1981 | Bolza-Schunemann . | |
| 4,349,185 | | 9/1982 | Small et al. . | |
| 4,396,336 | | 8/1983 | Malamood . | |
| 4,406,650 | | 9/1983 | Felix . | |
| 4,475,730 | | 10/1984 | Trogen . | |
| 4,494,741 | | 1/1985 | Fischer et al. . | |
| 4,508,527 | | 4/1985 | Uno et al. . | |
| 4,577,852 | | 3/1986 | Grunder . | |
| 4,650,447 | | 3/1987 | Meschi . | |
| 4,673,382 | * | 6/1987 | Buck et al. | 493/359 |
| 4,676,113 | * | 6/1987 | Bond | 74/102 |
| 4,700,939 | | 10/1987 | Hathaway . | |
| 4,714,394 | | 12/1987 | Ehlscheid et al. . | |
| 4,717,135 | | 1/1988 | Hathaway . | |
| 4,721,295 | | 1/1988 | Hathaway . | |
| 4,751,807 | | 6/1988 | Couturier . | |
| 4,770,402 | * | 9/1988 | Couturier | 493/412 |
| 4,824,426 | | 4/1989 | DuFresne . | |
| 4,846,454 | * | 7/1989 | Parkander | 493/412 |
| 4,874,158 | | 10/1989 | Retzloff . | |
| 5,076,559 | | 12/1991 | Lawniczak . | |
| 5,088,707 | | 2/1992 | Stemmler . | |
| 5,201,700 | * | 4/1993 | Meschi | 493/412 |
| 5,299,793 | | 4/1994 | Couturier . | |
| 5,730,695 | * | 3/1998 | Hauschild et al. | 493/416 |

* cited by examiner

SEPARATOR FINGER APPARATUS

FIELD OF THE INVENTION

The present invention relates to systems and methods for separating quantities of product, and more specifically, to systems and methods for separating web product into clips having a desired product count.

BACKGROUND OF THE INVENTION

Numerous machines and processes exist for controlling the output of web product which is to be separated into bundles or "clips" of a desired product count. In certain industries such as the paper industry, the demand for a high volume of product (such as folded and stacked napkins, tissues, paper towels, and the like) has spurred the design and development of machinery which can produce stacks of web product at a much faster rate than was ever possible with earlier systems. Two examples of such systems are disclosed in U.S. Pat. No. 4,770,402 issued to Couturier and U.S. Pat. No. 5,730,695 issued to Hauschild et al., the teachings of which are incorporated herein by reference insofar as they relate to separation fingers and associated mechanisms. Both patents address design difficulties regarding machines which stack product into clips having a desired number of folded items per clip. Many systems (including those of Couturier and Hauschild) employ a pair of folding rolls located above a stacking platform and a number of fingers which are manipulated to stack a stream of web product being folded upon the platform. After a number of web items (such as interfolded napkins or tissues) are stacked upon the platform, a set of fingers is inserted into the stream and is positioned above the stack upon the platform to define a clip having a known item quantity. A new clip is then formed above the fingers as the completed clip is lowered and moved to downstream operations.

In the prior art systems employing the above-described elements and system arrangement, a design problem arises in connection with the function and operation of the separation fingers which separate a completed clip from a clip being stacked. With reference to FIG. 1, which illustrates a prior art separator system, it can be seen that conventional separator finger mechanisms typically rotate the separation finger 1 about a single axis 3 through a range of positions into and out of a product stream 5 passing from between two folding rolls 6, 7. It should be noted that only one separation finger 1 is shown in FIG. 1 for purposes of clarity. In fact, most conventional systems employ a number of separation fingers 1 aligned side-by-side in a series which extends into the plane of the page of FIG. 1. Also, although only one series of separation fingers 1 is shown on the left side of FIG. 1 (only one series is necessary to separate a completed clip from a new clip), an additional series of fingers can be located on the opposite side of FIG. 1 as a mirror image of the separation fingers 1. As disclosed in the Couturier patent mentioned above, multiple sets of separation fingers can be advantageously used for moving and parting the clips.

The path of motion taken by the separation fingers 1 is illustrated by the dotted line A shown on FIG. 1. Each separation finger 1 usually has a flat upper surface in order to permit a stack of product to be formed on top of the separation finger 1. The preferred flat upper surface and pivoting feature of the separation finger 1 results in the L-shape found in many conventional separation fingers 1.

For proper control of the product stream leaving the folding rolls 6, 7, it is necessary to have the separation finger surfaces (upon which the product is stacked) close to the nip

8 between the folding rolls 6, 7. This orientation ensures proper folding and stacking of the product after it leaves the folding rolls 6, 7. However, this design preference conflicts with the ability of the separation finger 1 to pivot about its axis 3. By placing the separation finger 1 close to the nip 8, the pivoting separation finger 1 interferes with the folding rolls 6. Prior art systems attempted to avoid this interference in various ways. For example, in the Couturier patent above, circumferential grooves are located in the folding rolls. The base of the circumferential grooves is indicated by way of example as dotted line B on FIG. 1. By locating the separation finger within a groove, the separation finger has adequate clearance in its pivoting motion so that it does not interfere with the folding rolls (see the relationship between dotted lines A and B FIG. 1). A design drawback to this solution is that the grooves effectively weaken the folding rolls. Especially where long folding rolls are called for in a system and/or where the folding rolls need to be operated at relatively high speeds, numerous grooves in the folding rolls increase the chance for roll sagging, imbalance, and even failure. Another design solution to the separation finger and folding roll interference problem is disclosed in the Hauschild patent mentioned above. In the Hauschild patent, two sets of separating and carrying forks are used one set on either side of the product stack being built. This design permits the forks to be made shorter and therefore less able to interfere with the folding rolls during fork movement. However, the Hauschild design requires two sets of separation fingers rather than one, and calls for a relatively complicated mechanism to properly position and insert the forks into the web stream (note how the forks must be positioned at a particular angle and position prior to being rotated into the web stream). Also, the short forks used in Hauschild are unable to fully support the stack being built thereon, as is evident from the gap between the forks when they are placed in their stackbuilding position.

The design examples discussed above serve to illustrate the conflicting requirements of separation finger apparatuses. Long separation fingers provide adequate support for stacked product and can result in a simpler system design, but create problems with finger and roll interference, and undesirable roll features such as weak rolls or rolls unable to operate safely at high speeds. Short separation fingers can help to avoid finger and roll interference, but typically require a more complicated and expensive design, can result in inferior stack support, and can create the need for more separation fingers.

In light of the above design requirements and limitations, a need exists for a separator finger apparatus and method which provides adequate support for stacked product, utilizes a minimum number of separation fingers, has a simple design in which roll strength and speed capabilities are not compromised, locates separation fingers close to the folding rolls in their stack-building positions, and ensures minimal interference between the separation fingers and the folding rolls during system operation. Each preferred embodiment of the present invention achieves one or more of these results.

SUMMARY OF THE INVENTION

The present invention is a separation finger apparatus and method for inserting and removing a separation finger into a product stream or path in order to separate one group or "clip" of product from another. Preferably, the separation finger is coupled to elements which, when manipulated, pass the separation finger though an arcuately-shaped path. More preferably, the arcuately-shaped path is non-circular. Most preferably, the separation finger passes through the path by being simultaneously rotated and translated. While there exist a number of mechanisms and systems for accomplishing this task, the separation finger is preferably coupled to a translation member, which itself is preferably mounted for rotation about an axis. The separation finger is also preferably rotatably mounted to a pivot arm which is itself mounted for rotation about an axis on one end of the pivot arm. By turning either the translation member about its axis or the pivot arm about its axis, the separation finger is caused to translate or slide along a length of the translation member, thereby causing the separation finger to translate as well as rotate about the translation member axis. The resulting motion of the separation finger is a rotation of the separation finger as it translates and orbits about the axis of the pivot arm.

By translating and rotating in the above-described manner, the separation finger can travel having less interference with adjacent folding rolls. This permits the separation fingers to be utilized without requiring deep grooves in the folding rolls (resulting in stronger rolls able to operate as faster speeds).

In one preferred embodiment of the present invention, the translation member takes the form of a pair of translation shafts upon which the separation finger translates or slides via a translation block attached to the separation finger. In another preferred embodiment, the translation member is a finger guide having an elongated aperture in which the separation finger translates or slides. Preferably, the pivot arm and the translation member are both rotatably attached to respective pivot shafts which are preferably in fixed relationship to one another.

The unique motion of the separation finger provided by the present invention also results in the fact that longer separation fingers can be located more closely to the folding rolls. This permits the use of only one separation finger for bridging the stack-building surface upon which groups or clips or product are built. Such a design is simpler than the use in prior art systems of a pair of separation fingers (one on either side of the stackbuilding surface) to bridge the stack-building surface.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numerals indicate like parts.

DETAILED DESCRIPTION OF PREFERRED EMBODIMENTS

Figure 2:
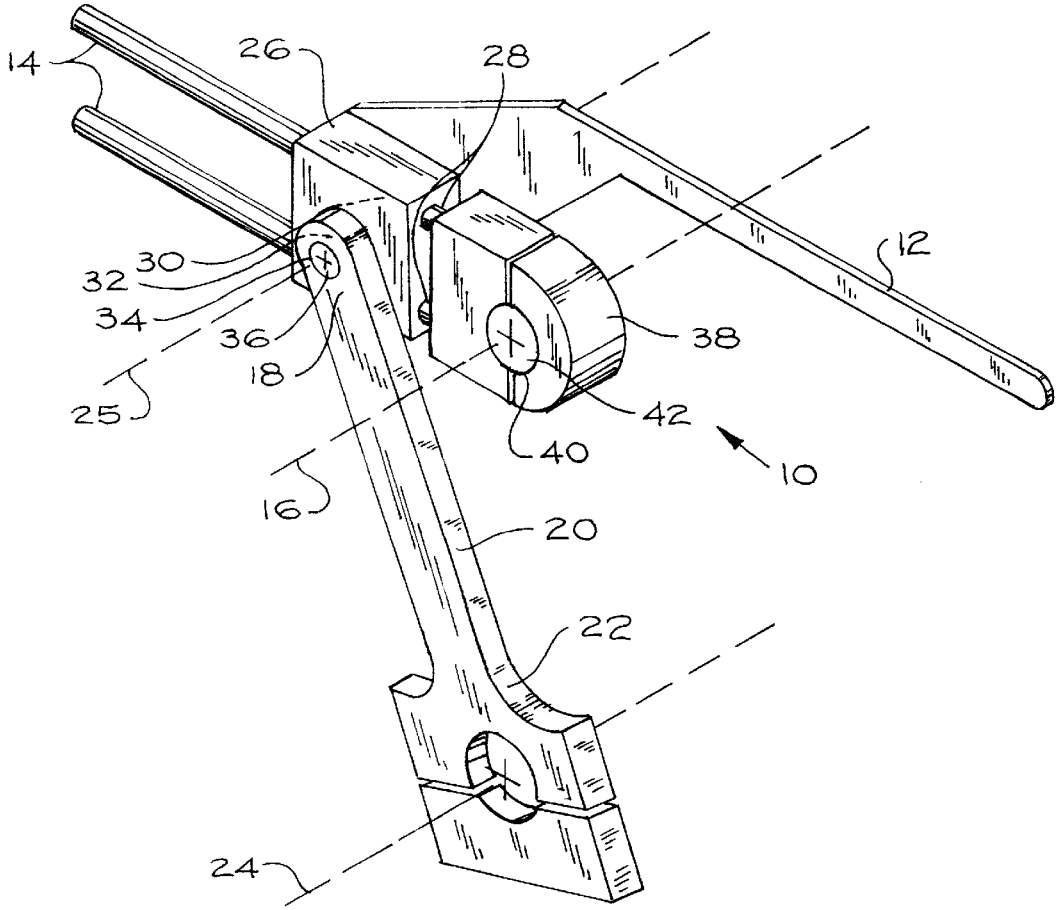
FIG. 2 is a perspective view of the separator finger apparatus according to a first preferred embodiment of the present invention.

A first preferred embodiment of the present invention is illustrated in FIG. 2. The first preferred embodiment of the present invention has a separation finger apparatus (indicated generally at 10) which is capable of movement which is neither purely linear nor purely rotational. Specifically, the separation finger apparatus 10 preferably has a separation finger 12 translatably attached to a pair of translation shafts 14 which are themselves mounted for rotation about a first axis 16 preferably located at one end of the translation shafts 14. The separation finger 12 is also pivotably attached to a first end 18 of a pivot arm 20, which has a second end 22 mounted for rotation about a second or orbit axis 24. The pivot arm 20 and the separation finger 12 rotate about a third axis 25. The separation finger apparatus 10 can therefore rotate about two pivot points located at the first and second axes 16 and 24, thereby causing the separation finger 12 to simultaneously translate along the translation shafts 14 as it rotates about the third axis at the first end 18 of the pivot arm 20. This relationship and movement of elements in the first preferred embodiment of the present invention permits the separation finger 12 to move in a non-circular and a nonlinear path. In particular, the separation finger 12 moves in an arcuate path as it travels toward and away from a stream of web product. The separation finger 12 rotates about the third axis 25 as it orbits about the second axis 24.

Looking now to the separation finger apparatus 10 in more detail, it should be noted that the separation finger 12 is preferably a thin elongated member which is of sufficient length to underlie substantially the entire width of a stack of product. This avoids the expense and complexity of two separation fingers 12 extending and meeting each other from opposite sides of the stack. The separation finger 12 is preferably attached in a conventional manner (such as by threaded fasteners, not shown) to a translation block 26. For ease of part replacement and maintenance, it is desirable to releasably attach the separation finger 12 to the translation block 26 with fasteners which themselves can be released and/or removed. However, it is possible to make the separation finger 12 and the translation block 26 from one piece of material, or to permanently join the two elements together (such as by welding or gluing).

The translation block 26 preferably has a pair of holes 28 therethrough for receiving each of the translation shafts 14 with a clearance fit. This permits the translation block 26 to translate or slide up and down in translational engagement with the translation shafts 14 while maintaining and securing the separation finger 12 against rotation with respect to the translation block 26. The translation shafts are preferably elongated rails or rods which can have virtually any cross-sectional shape.

It should be noted that the terms "translate" and "slide" and their various forms are used herein interchangeably. Both terms encompass any relationship between the translation block 26 and the translation shafts 14 (or other comparable elements as discussed herein) which permits one of the two elements to move in a manner which is not exclusively rotational or pivotal with respect to the other. Such movement includes without limitation movement of one of the elements through, along, beside, toward, or away from the other element. For example, in the preferred embodiment of the present invention, the translation shafts 14 slide within and through the holes 28 in the translation block 26 when the separation finger 12 is extended or retracted. However, the terms "translate" and "slide" encompass alternative relationships such as where the translation shafts are fitted with bearings of any type which themselves slide across the translation shafts 14, where the movement of the translation block 26 with respect to the translation shaft 14 is neither purely rotational nor purely non-rotational, where little to no physical contact occurs between the translation block 26 and the translation shafts 14 (such as in fluid bearings, with a magnetic or electromagnetic field causing the translation shafts 14 to "float"within the translation block), where one or more rollers or casters between the translation shafts 14 and the translation block 26 define rolling motion between the elements, and the like. All such manners of permitting relative and non-exclusively rotational movement between the translation shafts 14 and the translation block 26 fall within the spirit and scope of the present invention.

The translation block 26 and the separation finger 12 each preferably have pivot holes 30, 32, respectively, which are aligned with one another. The pivot holes 30, 32 are also preferably aligned with a pivot hole 34 in the first end 18 of the pivot arm 20. All three pivot holes 30, 32, 34 receive a pivot pin 36 which is retained therein in a conventional fashion (e.g., held by internally-threaded fasteners on each end of the pivot pin 36, secured via cotter pins on each end, etc.). The separation finger 12 and translation block 26 are therefore pivotably mounted via the pivot pin 36 to the pivot arm 20.

It will be appreciated by one having ordinary skill in the art that there exist a number of different ways in which the separation finger 12 and translation block 26 can be pivotably attached to the pivot arm 20. The particular arrangement disclosed herein is only one example of the many different elements and combinations of elements possible which achieve the same result of pivotably attaching the separation finger 12 and translation block 26 to the pivot arm 20. It is noted that the separation finger 12 can instead be sandwiched between the translation block 20 and the pivot arm 20, as opposed to the translation block 26 being sandwiched between the separation finger 12 and the pivot arm 20 illustrated in FIGS. 2 and 4. Also, the separation finger 12 (and translation block 26) need not necessarily be pivotably mounted to the pivot arm 20 near or between the translation shafts as shown in the figures. Instead, the pivot arm 20 can be pivotably mounted at another location along the separation finger, if desired. In short, the separation finger 12, pivot arm 20, and translation block 26, or equivalent elements can be coupled together (e.g., not necessarily physically touching each other), in a number of manners well-known to those skilled in the art to perform the functions described above. The same holds true for other preferred embodiments of the present invention, such as the second preferred embodiment described below.

The translation shafts 14 are preferably arranged in parallel relationship with one another and are attached in a conventional manner to a pivot head 38. Preferably, the pivot head 38 has a hole 40 therethrough sufficiently sized to receive a first pivot shaft 42. The translation shafts 14 can be attached to the pivot head 38 in any number of different ways well-known to those skilled in the art. For example, the ends of the translation shafts 14 can be threaded and be received within threaded holes in the pivot head 38. The translation shafts 14 can instead be integral with the pivot head 38 (e.g., made from the same element), or can be permanently attached thereto via welding, gluing, etc. However, for service and maintenance purposes, it is preferable that the translation shafts 14 be releasably attached to the pivot head 38.

The pivot head 38 is preferably secured to the first pivot shaft 42 for rotation therewith. The pivot head 38 can be secured in a number of different conventional manners, such as via setscrews or bushings (not shown). However, the pivot head 38 is preferably a conventional clamp mount which is releasably tightened on the first pivot shaft 42. It will be appreciated by one having ordinary skill in the art that the pivot head 38 can take a number of shapes and forms, each capable of performing the function of securing the translation shafts 14 for rotation with the first pivot shaft 42. Such other arrangements fall within the spirit and scope of the present invention.

As mentioned above, the first end 18 of the pivot arm 20 is preferably pivotably attached to the separation finger 12 and the translation block 26. The second end 22 of the pivot arm 20 preferably has a hole therethrough of sufficient size and shape for receiving a second pivot shaft 44. Preferably, the second end 22 of the pivot arm 20 is secured to the second pivot shaft 44 for rotation therewith. Like the pivot head 38, the pivot arm 20 can be secured to the second pivot shaft 44 in a number of different manners well-known to those skilled in the art (such as via setscrews, bushings, etc.). However, the second end 22 of the pivot a in 20 preferably is in the form of a conventional clamp mount releasably attached to the second pivot shaft 44. While the pivot arm 20 illustrated in the figures is preferably an elongated member, it will be appreciated by one having ordinary skill in the art that a number of different elements can be pivotably attached at both ends to achieve the same function as the pivot arm 20 disclosed herein.

The various elements of the separation finger apparatus 10 described above and illustrated in the drawings can be made from any number of materials, including metals (such as steel, aluminum, or iron), plastics, and composites, or combinations of the same. Other element materials include wood, fiberglass, glass, ceramics, and other refractory materials. To meet demanding strength requirements, the translation shafts 14 and the first and second pivot shafts 42, 44 are preferably made from steel.

Figure 4:
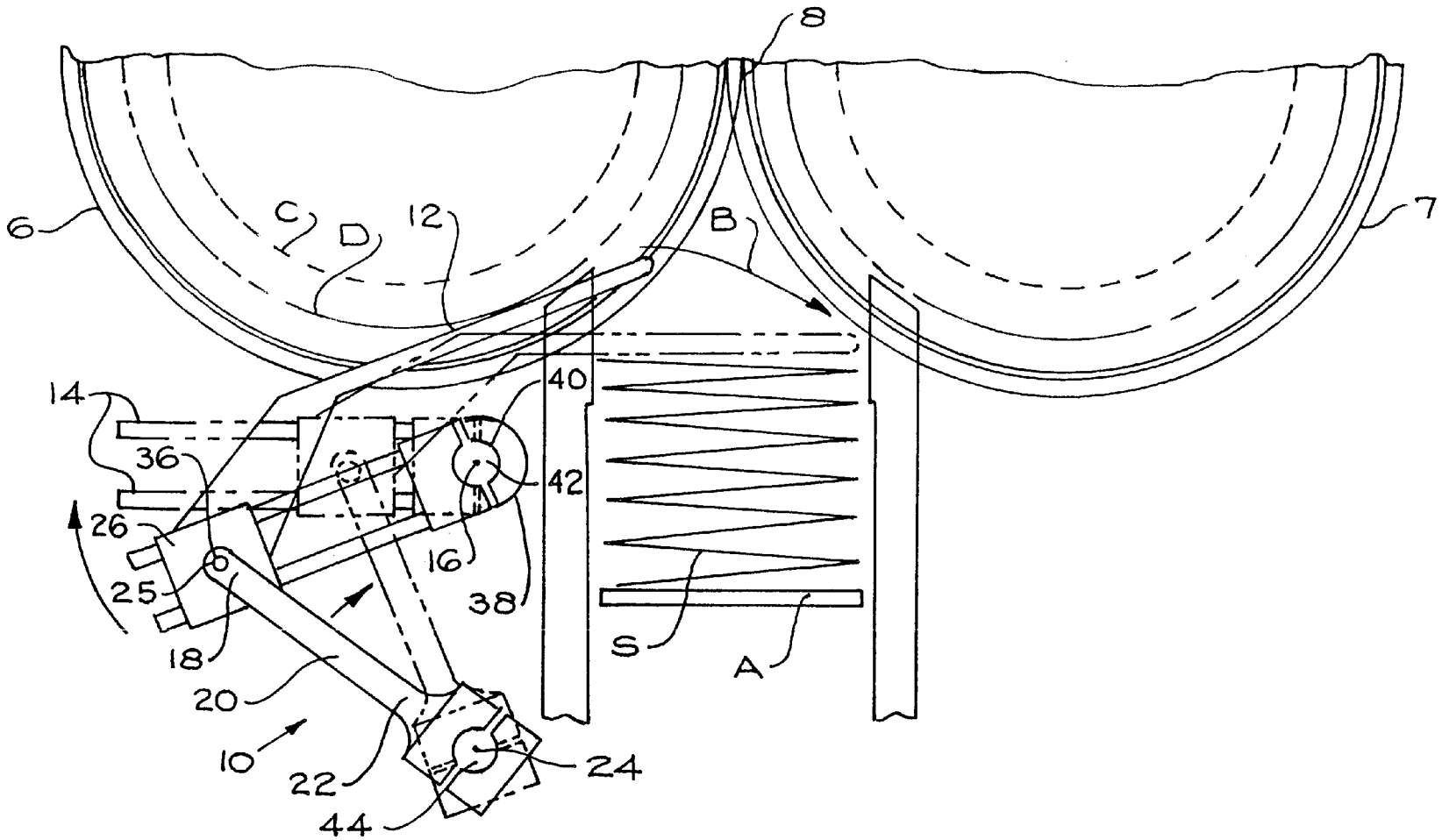
FIG. 4 is a cross-sectional view of the separator finger apparatus according to the first preferred embodiment of the present invention, shown installed in a stacker of an interfolding machine.

When installed within a system as shown in FIG. 4, the separation finger apparatus 10 is placed beneath the folding rolls 6, 7 such that the separation finger 12 assumes a place beneath the nip 8 between the folding rolls 6, 7 when the separation finger apparatus 10 is placed in its extended position shown in solid lines in FIG. 4. It should be noted that the separation finger apparatus 10 can be mounted in various operative locations within a system, dependent upon the desired function the separation finger apparatus 10 is to perform during system operation. For example, the separation finger apparatus 10 can be mounted for movement with the surface upon which stacked product is built, or can be mounted to a frame of the machine in which it is installed. Both examples are seen in the Couturier patent mentioned above (referring to the first and second count fingers 28 and 48 of Couturier, respectively). In the first example, the first and second pivot shafts 42, 44 are preferably mounted for rotation in a conventional manner upon part of the mechanism or system which moves as product items are stacked upon the stack-building surface. Thus, the first and second pivot shafts 42, 44 move with the surface upon which product is stacked. In the second example, the first and second pivot shafts 42, 44 are preferably mounted for rotation in a conventional manner upon the frame of the machine in which the separation finger apparatus 10 is installed. In either case, 435 the first and second pivot shafts 42, 44 can be mounted via bearings (not shown) located on both ends of the pivot shafts 42, 44, thereby keeping the pivot shafts 42, 44 in fixed parallel relationship with one another. Other manners of rotatably securing the pivot shafts 42, 44 are well-known to those skilled in the art, and are not therefore discussed further herein.

As can be seen from FIG. 4, with both pivot shafts 42, 44 being secured in place with respect to one another (either on the machine frame, on a carriage, or on another element or assembly within the machine), rotation of one pivot shaft 42, 44 causes the other pivot shaft to rotate and the separation finger 12 to move via the translation block 26 and translation shaft 14 connection. It should be noted that although not the preferred manner of operation, it is possible to mount the pivot shafts 42, 44 for movement with respect to one another while still manipulating the elements of the separation finger apparatus 10 as described herein to achieve the same results. For example, movement of the lower pivot shaft 44 in an upward or downward motion toward or away from the upper pivot shaft 42 (respectively) will act to assist in the retraction and insertion (respectively) of the separation finger 12 by causing the translation block 26 to translate or slide along the translation shafts 14.

Although rotation of either pivot shaft 42, 44 will cause the desired movement of the separation finger 12 through a continuous range of positions between its extended and retracted positions shown in FIG. 4, test results show that less torque is required to move the separation finger 12 by turning the second pivot shaft 44. As such, the second pivot shaft 44 is preferably connected in a conventional manner to a driving device (not shown) which works to pivot the second pivot shaft 44 about its axis 24. Various types of driving devices exist which are well-known to those skilled in the art and which can be used to pivot the second pivot shaft 44. Examples of such driving devices include actuators (air, fluid, etc.), solenoids (fluid, electric, electromagnetic, etc.) and motors. However, for applications where the separation finger 12 must be moved into and out of place rapidly, an air actuator is preferred. Such an actuator is described in the Couturier patent mentioned above, the teachings of which are incorporated herein by reference insofar as they relate to shaft actuators and related mechanisms. One having skill in the art will recognize that a number of systems, assemblies, and devices (and their associated equipment) can be used to turn the second pivot shaft 44. Each of these other systems, assemblies, and devices falls within the present invention.

In operation, each separation finger apparatus 10 (remembering that there typically exists a series of separation fingers 12 extending into the plane of the page of FIG. 4) is in its retracted position shown in dotted lines on FIG. 4. At a desired time, which can correspond to the completion of a stack S built upon a stack building surface A, the driving device connected to the second pivot shaft 44 is activated. This activation can be performed for example by a system controller, by a signal sent from one or more sensors monitoring the stack building process, or even manually. Such activation "tiggers" are well-known in the art and depend largely upon the particular system design and use. Upon being activated, the driving device turns the second pivot shaft 44 about its axis 24, thereby exerting a rotational force upon the pivot arm 20 attached to the second pivot shaft 44. As the pivot arm 20 is rotated, it exerts a force upon the translation block 26, which reacts by translating or sliding along the translation shafts 14. The motion of the translation block 26 causes the translation shafts 14 to pivot about the first axis 16 as the translation block 26 travels along the length of the translation shafts 14. The translating or sliding motion of the translation block 26 and the rotational motion of the side shafts 14 about the first axis 16 generates an arcuately-shaped movement of the separation finger 12 attached to the translation block 26. This movement can be seen in the dotted line labeled B on FIG. 4, which show the progressive movement of the tip of the separation finger 12 as the separation finger 12 travels between the retracted and extended positions.

It can be seen from the motion of the separation finger 12 in FIG. 4 that the separation finger 12 can extend fully across the stack-building surface S upon which stacks of product are built. This provides the advantage of eliminating the need for two separation fingers 12 (one on either side of the stack-building surface S) to extend across the stack-building surface S. Thus, system design is simplified and system costs are lowered.

Figure 1:
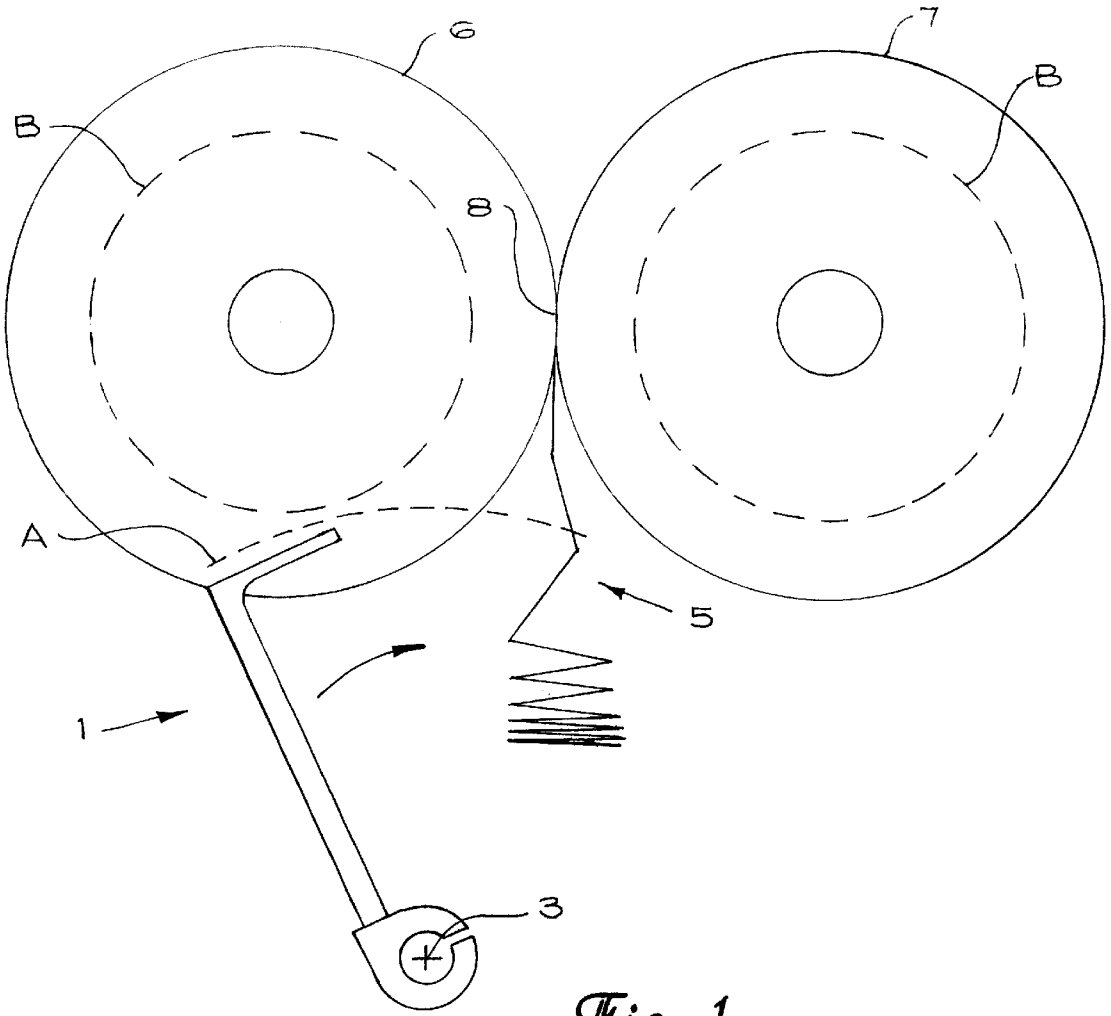
FIG. 1 is a cross-sectional view of a separator finger apparatus according to the prior art.

Also, by virtue of the arcuate motion of the separation finger 12, the amount of interference with the folding rolls 6, 7 is lowered significantly. In particular, a comparison of FIGS. 1 and 4 shows the difference in the amount of separation finger-to-roll interference between the two designs. For purposes of illustration, the groove depth necessary for the 15 , separation finger design illustrated in FIG. 1 is shown on FIG. 4 as the dotted circle labeled C, while the groove depth necessary for the separation finger design of the present invention is shown on FIG. 4 as the dotted circle labeled D. Clearly, by avoiding a circular path of the separation finger 12 as is found in the prior art, the arcuate motion of the separation finger 12 in the present invention permits the separation fingers 12 to be brought close to the folding rolls 6, 7 while creating less separation finger-to-roll interference and therefore, requiring less groove depth within the folding rolls 6, 7. As a result, the rolls 6, 7 are stronger, and (because roll runout from higher speeds is lowered due to stronger rolls 6, 7) can be run at higher speeds or be made longer if desired.

In addition to the above-noted advantages realized by the present invention, the separation finger 12 is better adapted to be inserted within a stream of web product emitting from between the folding rolls 6, 7. It can be seen from FIG. 4 that the separation finger 12 falls as it is moved from its retracted position to its extended position. As opposed to a number of prior art finger insertion mechanisms which quickly and directly insert fingers horizontally into the stream of web material, the separation finger 12 in the present invention falls with the stream of web material as it is inserted. This motion is gentler on the web material, and permits very light and delicate web material to be processed and stacked in the system. Especially where web material is used which is easily punctured or ripped (e.g., foils, tissues, etc.), the inserting and falling motion of the present invention provides significant advantages over the prior art.

Figure 3:
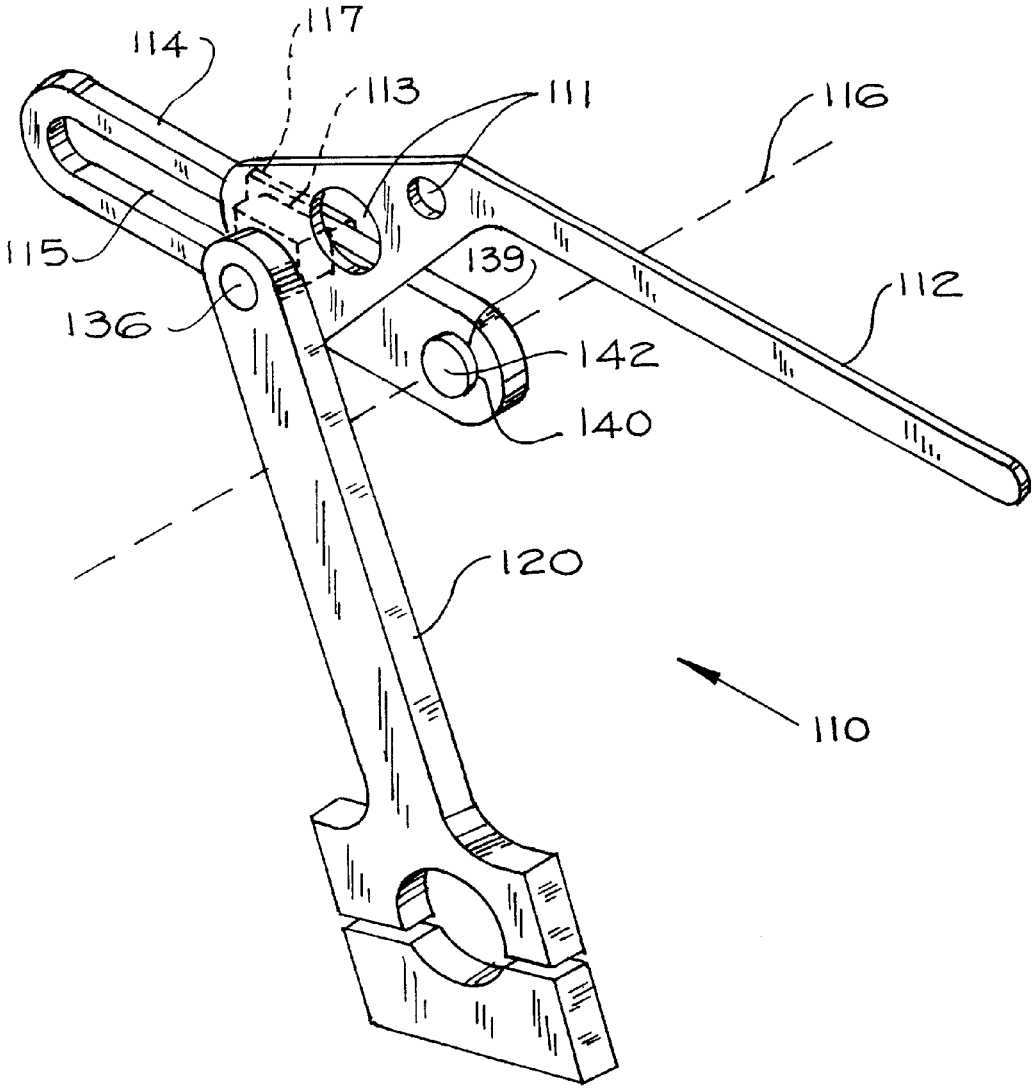
FIG. 3 is a perspective view of the separator finger apparatus according to a second preferred embodiment of the present invention.

A second preferred embodiment of the present invention is illustrated in FIG. 3. The separation finger 112 of the second preferred embodiment is substantially the same as the separation finger 12 of the first preferred embodiment, with the exception of the differences described below.

Where high-speed system operation is a necessity, one significant problem which arises involves the related factors of system weight and inertia In particular, higher web stream speeds require faster separation finger speeds. Among other design challenges which arise from the need for faster separation finger speeds, the weight of the separation finger apparatus 110 presents difficulties in accelerating and decelerating the separation finger 112 during separation finger insertion and retraction operations. In short, the heavier the separation finger apparatus 110 is, the higher the torque necessary to accelerate the separation finger to the necessary speed and the greater the impact which is created once the separation finger reaches the end of its stroke. Both results are undesirable and are addressed by the design of the second preferred embodiment.

In order to reduce the weight of the separation finger apparatus 110, the translation shafts 14 and the clamp mount design of the pivot head 38 of the first preferred embodiment is replaced by an elongated finger guide 114. The finger guide 114 has an elongated hole 115 passing therethrough which runs a substantial length along the finger guide 114. At one end of the finger guide 114 is located a second hole 140 through which the first pivot shaft 142 passes. Although the finger guide 114 is prevented from movement along the first pivot shaft 142 by rings 139 flanking the finger guide and secured to the first pivot shaft in a conventional manner, the finger guide 114 is free to rotate about the first pivot shaft 142.

The translation shafts 14 of the first preferred embodiment and the finger guides 114 of the second preferred embodiment function in much the same way. Both are translational or slide members which are configured (preferably elongated) to permit the separation finger 12, 112 to translate or slide therealong, whether via a translation block 26 or otherwise. Both are mounted for rotation about an axis 16, 116, which can be the central axis of a pivot shaft 42, 142. It will be appreciated that a number of other elements can perform these functions, the two described and shown herein serving to illustrate two preferred examples of such a member.

Additional weight is also removed from the separation finger apparatus 110 by the removal of the translation block 26 of the first preferred embodiment. The separation finger 112 has a fitting 113 which is engaged within the elongated hole 115 in the finger guide 114. The fitting 113 has a flat upper surface and a flat lower surface which respectively face the interior upper and lower surfaces of the finger guide hole 115 and therefore prevent the separation finger 112 from rotating with respect to the finger guide 114. The fitting, 113 also has a flange 117 which maintains the fitting 113 and the separation finger 112 within the finger guide 114. It will be appreciated by one having ordinary skill in the art that different elements can be used to secure the finger guide 114 against axial movement along the first pivot shaft, to guide the fitting 113 and the separation finger 112 within the finger guide 114 without permitting rotation of the separation finger 112 therein, and to keep the separation finger 112 within the finger guide 114. For example, the separation finger 112 can have a raised rib (not shown) which fits within the elongated hole 115 in the finger guide 114, or can have a pair of pins (not shown) spaced apart and fitted within the elongated hole 115. The rib can have a bend or the pins can have heads to keep the separation finger 112 within the finger guide 114. Such alternate designs all share the common function of guiding the separation finger 112 within the finger guide 114 while preventing the separation finger 112 from rotating therein or from becoming disconnected from the finger guide 114. These alternate designs fall within the present invention.

It should be noted that the pivot pin 136 connection between the pivot arm 120 and the separation finger 112 is substantially the same as that described above with reference to the first preferred embodiment of the present invention, with the only exception being the fact that the separation finger 112 is located between the finger guide 114 and the pivot arm 120.

To further reduce the weight of the separation finger apparatus 110, holes 111 can be made in the separation finger 112 at locations where an excess of material is determined to exist. Also, since the primary loading force supported by the separation finger 112 is typically in the vertical direction, the separation finger 112 can be made relatively thin, with the necessary strengthening material for the separation finger 112 being located in the plane of the separation finger 112.

The various elements making up the separation finger apparatus 110 of the second preferred embodiment are preferably made from the same materials as those discussed in the first preferred embodiment described above and illustrated in the drawings. However, due to the replacement of the translation shafts 14 with the finger guide 114, it is possible to use different material for the finger guide 114 (rather than a heavy material such as steel). The finger guide 114 is preferably made from an engineered plastic or an ultra-high molecular weight (UHMW) material.

Though physically different from the first preferred embodiment in the ways described above, the second preferred embodiment of the present invention operates in substantially the same way to achieve the same advantages and results as described in connection with the first preferred embodiment. The separation finger apparatus 110 acts to preferably simultaneously translate and rotate the separation finger as it is inserted into or removed from a stream of web product. The separation finger apparatus 110 permits finger insertion fully across a stack-building station close to the folding rolls, (eliminating the need for a pair of fingers to perform this fiunction), does so with much lower finger-to-roll interference than the systems and devices of the prior art to thereby avoid sacrificing roll strength and speed capabilities, and provides a simpler and more cost-effective design than in prior art systems and devices.

In yet another alternative embodiment of the present invention (not shown), the preferred embodiment illustrated in FIGS. 1 and 2 and described above is modified to further reduce the weight and resulting inertia of the apparatus. In this alternative embodiment, one of the two translation shafts 14 is removed, and the apparatus is left only with one translation shaft 14 along which the translation block 26 moves. Although the preferred embodiment of FIGS. 1 and 2 is preferred from the standpoint of system stability, the substantially the same system with only one translation shaft 14 can be used, particularly where the other elements of the apparatus (such as the pivot arm 20 and pivot head 38) are adequately mounted to prevent significant movement of the apparatus along or parallel to the axes of the apparatus. To help prevent such movement or "twist" of the translation shaft 14 with respect to the translation block 26, the cross-sectional shape of the translation shaft 14 and the matching shape of the hole 28 in the translation block 26 are preferably selected to resist turning of the translation shaft 14 in the hole 28. This shape can be square, hexagonal, triangular, rectangular, star or X-shaped, and the like.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, in the preferred embodiments of the present invention as described above, the second pivot shaft 44, 144 is preferably driven to drive the separation finger apparatus 10, 110. However, it is possible to instead drive the separation finger apparatus 10, 110 by driving the first pivot shaft 42, 142. In doing so, the translation block 26 or the separation finger 112 translates or slides down the translation shafts 14 or finger guide 114, respectively, thereby causing the translation shaft 14 or finger guide 114 and pivot arm 20, 120 to rotate and move the separation finger 12, 112 through its path. The first pivot shaft 44, 144, the second pivot shaft 42, 142, or even both can be driven if desired.

Also, it should be noted that for purposes of driving the separation finger apparatus 10, 110, it is not necessary to clamp or fix the separation finger apparatus 10, 110 for rotation with both pivot shafts 42, 142 and 44, 144. In fact, the separation finger apparatus 10, 110 need only be fixed for rotation with the pivot shaft 42, 142, 44, 144 which drives the apparatus. The other pivot shaft acts to hold the remainder of the separation finger apparatus 10, 110 in proper position as it passes through its range of motion. Therefore, the separation finger apparatus 10, 110 need only pivot about the other pivot shaft rather than being clamped for rotation therewith. If other methods of driving the separation finger apparatus 10, 110 of the present invention are employed (which do not rely upon turning either pivot shaft 42, 142, but instead upon directly pushing or pulling other part(s) of the apparatus such as the pivot arm 20, 120 or the separation finger 12, 112), the separation finger apparatus 10, 110 need not be fixed to rotate with either pivot shaft 42, 142. Instead, the separation finger apparatus 10, 110 need only pivot about the pivot shafts 42, 142.

Finally, it will be appreciated by one having ordinary skill in the art that a number of systems, devices, and mechanisms exist for absorbing system shock and for controlling the slowdown and stopping of the separation finger apparatus 10, 110. Such systems, devices, and mechanisms can be employed with the present invention to control its shock and motion, and are particularly important as the speeds at which the present invention operate increase. Shock absorption and controlled slowdown systems are well-known the art, and can be valuable for extending the life of the separation finger apparatus 10, 110 and the systems in which the present invention is installed.

Having thus described the invention, what is claimed is:

1. A separation finger apparatus for removable insertion into a stream of web material issuing from a rotating roll, the separation finger apparatus comprising:

a separation finger movable with respect to the rotating roll toward and away from the stream of web material issuing from the rotating roll;

a translation member mounted for rotation about a first axis, the translation member being coupled to the separation finger and in translating engagement therewith, the translation member having a length along which the separation finger can translate with respect to the rotating roll in its movement toward and away from the stream of web material issuing from the rotating roll;

a pivot member rotatably coupled to the separation finger for rotation with respect to the rotating roll about a second axis, the translation member and the pivot member being rotatable with respect to one another to simultaneously translate and rotate the separation finger in a range of positions upon the length of the translation member between and including a retracted position and an extended position with respect to the stream of web material issuing from the rotating roll.

2. The separation finger apparatus as claimed in claim 1, wherein the pivot member is coupled to the separation finger at a first location on the pivot member, the pivot member being mounted for rotation about a third axis at a second location on the pivot member, the third axis being in fixed relationship to the first axis in the range of positions of the separation finger.

3. The separation finger apparatus as claimed in claim 2, wherein the pivot member is an elongated arm and wherein the first location and the second location of the elongated arm are on opposing ends of the elongated arm.

4. The separation finger apparatus as claimed in claim 2, wherein the separation finger and the translation member are secured against rotation with respect to one another.

5. The separation finger apparatus as claimed in claim 2, further comprising a pivot shaft coincident with the third axis, the pivot member being mounted to the pivot shaft for rotation about the third axis.

6. The separation finger apparatus as claimed in claim 1, wherein the translation member comprises at least one rod upon and along which the separation finger translates, the at least one rod being mounted for rotation about the first axis.

7. The separation finger apparatus as claimed in claim 1, wherein the translation member comprises an element having an elongated aperture formed therein, at least a part of the separation finger being secured within and adapted to translate within the elongated aperture through the range of positions of the separation finger.

8. The separation finger apparatus as claimed in claim 1, further comprising a translation block attached to the separation finger, the translation block being coupled for translation to the translation member for translational movement along a length of the translation member through the range of positions of the separation finger.

9. The separation finger apparatus as claimed in claim 1, further comprising a first pivot shaft coincident with the first axis, the translation member being mounted to the first pivot shaft for rotation about the first axis.

10. The separation finger apparatus as claimed in claim 9, further comprising a second pivot shaft coincident with the third axis, the pivot member being mounted to the second pivot shaft for rotation about the third axis.

11. The separation finger apparatus as claimed in claim 1, wherein the separation finger and the translation member are secured against rotation with respect to one another.

12. The separation finger apparatus as claimed in claim 1, wherein the separation finger has a proximal end to which is coupled the translation member and a distal end for insertion into the stream of web material.

13. A separation finger apparatus for moving a separation finger toward and away from a stream of web material issuing from a rotating roll, the separation finger apparatus comprising:

a pivot axis;

an orbit axis located a distance from the pivot axis;

a separation finger movable with respect to the rotating roll, the separation finger having an extended position inserted into the stream of web material issuing from the rotating roll; and a retracted position withdrawn from the stream of web material issuing from the rotating roll, the separation finger pivotably mounted about the pivot axis, the separation finger also mounted to orbit with respect to the rotating roll about the orbit axis to move the separation finger through an arc between its extended and retracted positions with resect to the stream of web material.

14. The separation finger apparatus as claimed in claim 13, further comprising a translation member slidably engaged with the separation finger and mounted for rotation about a translation member axis located a distance from the orbit axis and the pivot axis.

15. The separation finger apparatus as claimed in claim 14, wherein the translation member has defined therein an elongated aperture having a length, the separation finger being slidably engaged within and adapted to translate along the length of the elongated aperture.

16. The separation finger apparatus as claimed in claim 14, wherein the translation member comprises at least one elongated rod mounted for rotation about the translation member axis, the separation finger coupled to the at least one elongated rod to translate therealong in the orbit of the separation finger.

17. The separation finger apparatus as claimed in claim 14, wherein the translation member axis and the orbit axis are fixed relationship with one another.

18. The separation finger apparatus as claimed in claim 17, where in the separation finger is secured against rotation with respect to the translation member.

19. The separation finger apparatus as claimed in claim 18, wherein the separation finger is engaged to the translation member near the pivot axis of the separation finger.

20. The separation finger apparatus as claimed in claim 17, wherein the translation member is rotatably secured at the translation member axis to a pivot shaft.

21. The separation finger apparatus as claimed in claim 17, further comprising a pivot arm rotatably coupled at a first end to a pivot shaft located on the orbit axis and rotatably coupled at a second end to the separation finger.

22. The separation finger apparatus as claimed in claim 13, wherein the translation member is rotatably secured at the translation member axis to a second pivot shaft.

23. A separation finger apparatus for moving a separation finger toward and away from a stream of web product issuing from a rotating roll the separation finger apparatus comprising:

a separation finger movable with respect to the rotating roll, and the stream of web product issuing therefrom, the separation finger having an extended position in which the separation finger is extended into the stream of web product issuing from the rotating roll; and a retracted position in which the separation finger is retracted from the stream of web product issuing from the rotating roll;

wherein the separation finger is mounted for simultaneous translation and rotation with respect to the rotating roll between the extended and retracted positions.

* * * * *

US006254522C1

(12) EX PARTE REEXAMINATION CERTIFICATE (6098th)

United States Patent
Schmidt, V

(10) Number: US 6,254,522 C1
(45) Certificate Issued: Jan. 15, 2008

(54) SEPARATOR FINGER APPARATUS

(75) Inventor: Charles Louis Schmidt, V, Florence, WI (US)

(73) Assignee: C.G. Bretting Manufacturing Company, Inc., Ashland, WI (US)

Reexamination Request:
No. 90/008,314, Nov. 27, 2006

Reexamination Certificate for:

| | |
|---|---|
| Patent No.: | **6,254,522** |
| Issued: | **Jul. 3, 2001** |
| Appl. No.: | **09/412,256** |
| Filed: | **Oct. 5, 1999** |

(51) Int. Cl.
*B31B 1/26* (2006.01)

(52) U.S. Cl. ..... 493/412; 493/416; 493/357; 493/414

(58) Field of Classification Search ..... None
See application file for complete search history.

(56) References Cited

U.S. PATENT DOCUMENTS 4,874,158 A 10/1989 Retzloff
4,949,953 A 8/1990 Claassen

*Primary Examiner*—Jeanne M Clark

(57) ABSTRACT

A separator finger apparatus and method for insertion of a separation finger into and removal from a stream of web product. The unique motion provided by the elements making up the separation finger apparatus permits the separation finger to be mounted close to folding rolls (from which the web product issues) with reduced separation finger-to-folding roll interference. Specifically, the separation finger is manipulated to rotate and translate simultaneously as it is inserted into or removed from the stream of web product. The elements creating the separation finger motion are preferably a pivot arm mounted for rotation about a first axis and a translation member mounted for rotation about a second axis. The pivot arm is preferably rotatably coupled to the separation finger at a third axis. The separation finger is preferably coupled to the translation member for translational or sliding motion therealong. With these connections, a rotational movement of either the pivot arm or the translation member about their respective first and second axes causes the simultaneous rotation of the translation member (and attached separation finger) and orbiting of the separation finger about the first axis. This motion creates an arcuately-shaped path for the separation finger, which thus translates and rotates into the stream of web product with less folding roll interference than a circular path would produce and with gentler motion to the web product than a purely linear translation would produce. The invention permits longer web separation fingers to be used, which in turn requires fewer separation fingers.

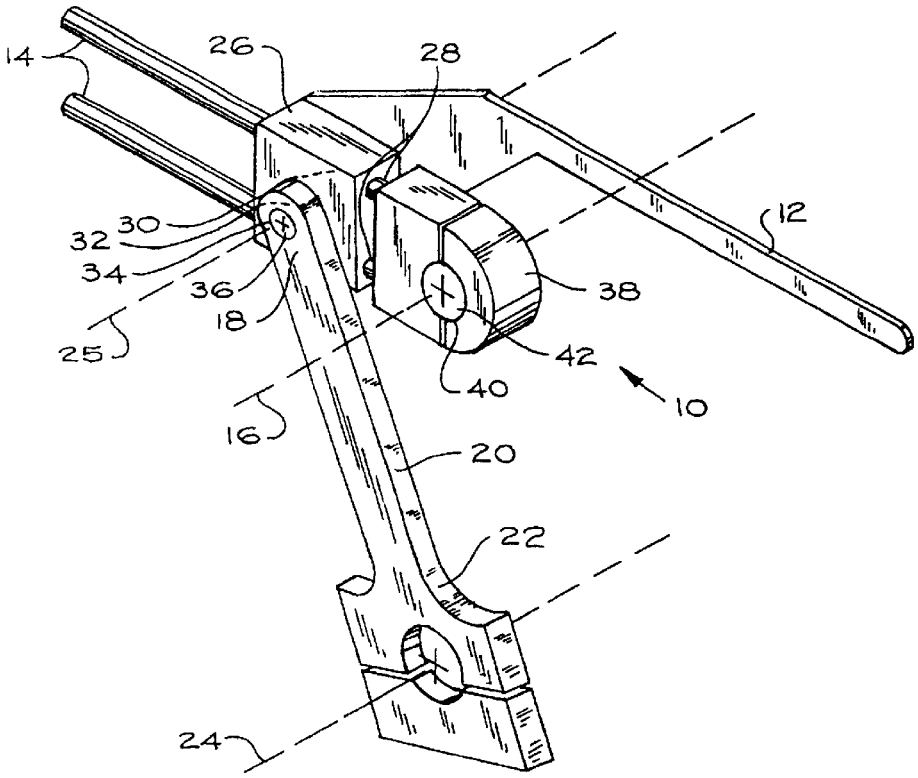

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 23 is cancelled.

Claims 1–22 were not reexamined.

* * * * *